United States Patent [19]

Mosburger

[11] Patent Number: 4,818,330

[45] Date of Patent: Apr. 4, 1989

[54] ONE-SIDED CORRUGATED BOARD MACHINE HAVING REPLACABLE CORRUGATING ROLLERS

[75] Inventor: Hans Mosburger, Weiherhammer, Fed. Rep. of Germany

[73] Assignee: BHS-Bayerische Berg-, Hütten- und Salzwerke Aktiengesellschaft, Fed. Rep. of Germany

[21] Appl. No.: 97,204

[22] Filed: Sep. 16, 1987

[30] Foreign Application Priority Data

Sep. 18, 1986 [DE] Fed. Rep. of Germany ..... 3631803

[51] Int. Cl.[4] ..... B31F 1/28

[52] U.S. Cl. ..... 156/473; 156/555; 156/582

[58] Field of Search ..... 156/470, 471, 472, 473, 156/555, 582, 205, 209, 212, 210, 462; 248/652, 666; 264/369; 100/47, 168

[56] References Cited

U.S. PATENT DOCUMENTS

| | | | |
|---|---|---|---|
| 3,707,909 | 1/1973 | Volkers | 100/168 |
| 4,127,066 | 11/1978 | Sharkey | 100/168 |
| 4,620,896 | 11/1986 | Sueki et al. | 156/471 |
| 4,629,526 | 12/1986 | Kanda | 156/472 |
| 4,631,109 | 12/1986 | Hirakawa et al. | 156/472 |
| 4,685,390 | 8/1987 | Pau et al. | 100/168 |

FOREIGN PATENT DOCUMENTS

| | | | |
|---|---|---|---|
| 144536 | 6/1985 | European Pat. Off. | 156/472 |
| 518939 | 6/1921 | France | 156/470 |
| 1538604 | 9/1968 | France | 156/471 |

*Primary Examiner*—Merrell C. Cashion, Jr.
*Attorney, Agent, or Firm*—Silverman, Cass, Singer & Winburn, Ltd.

[57] ABSTRACT

One-sided corrugated board machine having at least two pairs of corrugated rollers, each pair forming an assembly including a lower corrugated roller and an upper corrugated roller. Each of the pairs of rollers is supported on a movable, lockable bearing bracket that is movably secured to walls or supports of the machine. A movable clamping roller and a movable glue-applying device is provided such that they can be moved away to allow the assembly to be moved from one position to another. When it is desired to exchange one assembly for another the clamping roller and the glue-applying device are moved out of the way. The bearing bracket supporting one assembly is then moved from a work position to a rest position and the bearing bracket supporting another assembly is moved from its rest position to the work position replacing the first assembly.

4 Claims, 2 Drawing Sheets

ONE-SIDED CORRUGATED BOARD MACHINE HAVING REPLACABLE CORRUGATING ROLLERS

BACKGROUND OF THE INVENTION

This invention relates to corrugated board machines and more particularly to a one-sided corrugated board machine having a movable glue-applying device and a roller assembly that is easily accessible for changing or replacing the rollers.

One prior art one-sided corrugated board machine is disclosed in French Pat. No. FR 1,538,604. In this arrangement, two pairs of corrugated rollers are positioned on rotatable bearing brackets in the form of disks. The prior art roller assembly is not easily accessible and it is, therefore, difficult to replace or change the rollers. Furthermore, it has not been possible to supply such a corrugated board machine with only one roller assembly and to later re-equip the one roller assembly to the plural assembly form.

SUMMARY OF THE INVENTION

The above and other disadvantages of the prior art corrugated board machines are overcome by providing a corrugated board machine wherein the corrugated roller assembly is easily accessible for changing.

The individual corrugated roller assemblies are positioned on separate bearing brackets which can be moved or swung into either a work or a rest position. Once the roller assembly is pivoted into the rest position it is freely accessible for changing. The arrangement is such that the one-sided corrugated board machine can be initially provided with a single roller assembly and a second roller assembly can be installed later, if needed. Further, by simply exchanging roller assemblies a one-sided corrugated board can be produced with different corrugation profiles. Additionally, if a worn roller assembly must be replaced by a new one the change can take place without lengthy equipment downtime.

DESCRIPTION OF THE PREFERRED EMBODIMENTS

Figure 1:
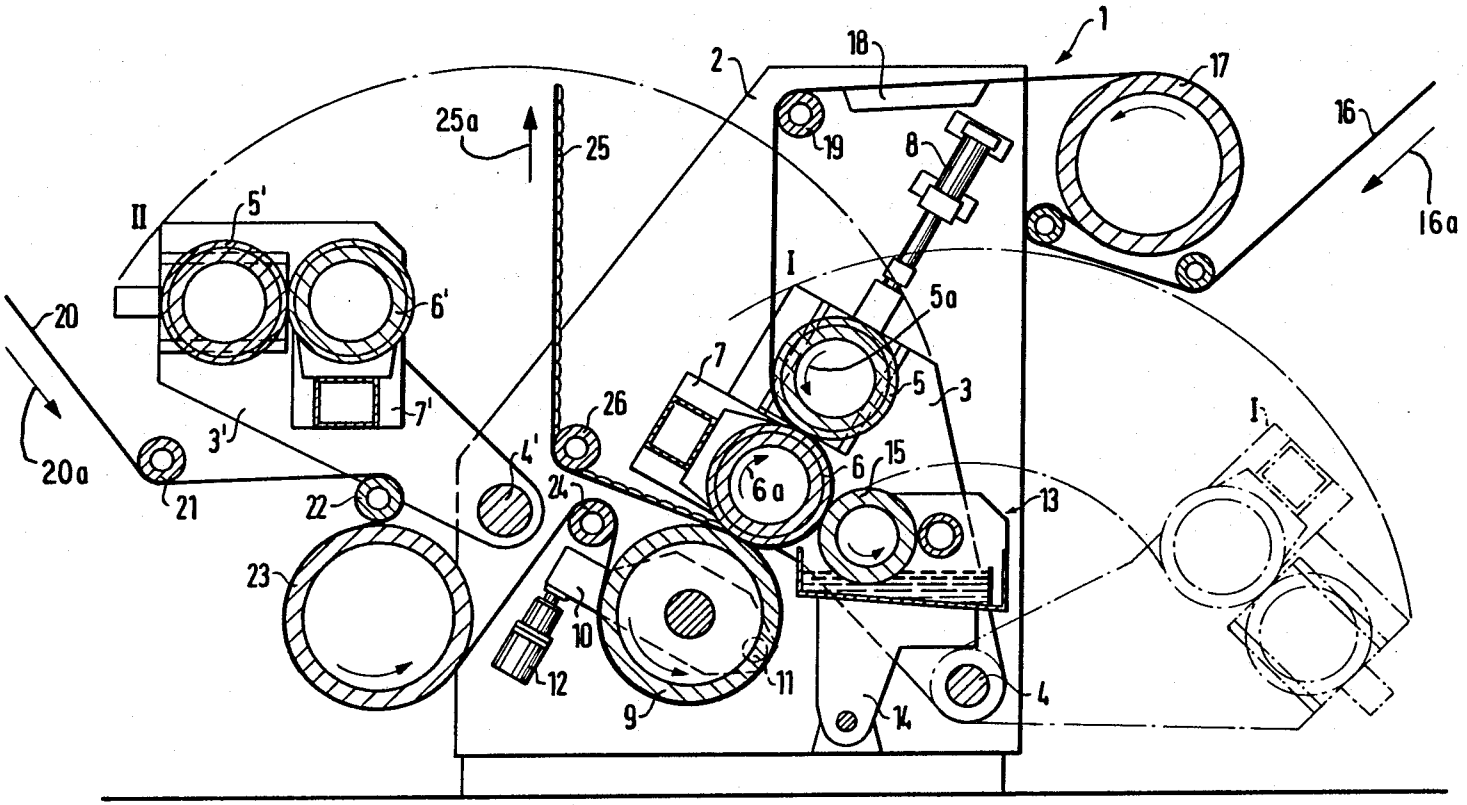
FIG. 1 is a diagrammatic side view of the one-sided corrugated board machine embodying the present invention.

Referring to FIG. 1, a corrugated board machine which embodies the present invention is designated by the numeral 1. The corrugated board machine 1 has, as is normal, walls or supports 2 which are rigidly connected one to another. Bearing brackets 3 and 3' are supported in a pivotable manner around axes 4 and 4' on the walls or supports 2. The bearing brackets 3 and 3' have the same general shape and each support a pair of corrugated rollers forming an assembly having an upper corrugated roller 5 or 5' and a lower corrugated roller 6 or 6'. A roller assembly I is formed from the corrugated rollers 5 and 6 and is shown in a work position. A roller assembly II is formed from the corrugated rollers 5' and 6' and is shown in an outwardly pivoted rest position. A drive (not shown) can be provided to rotate the lower corrugated roller 6 in the direction indicated by arrow 6a. The rotation of roller 6 will encourage the adjacent roller 5 to be carried along and rotate in a direction indicated by arrow 5a.

Built-in suction devices 7 or 7' are provided to cooperate with the lower corrugated roller 6 or 6', respectively, and hold the corrugated paper sheet in a clamped manner on the surface of the suction roller 6 or 6' when the respective roller is in the work position.

The lower corrugated rollers 6 and 6' are supported in a stationary manner on the bearing brackets 3 and 3', respectively. The upper corrugated rollers 5 and 5' are supported in an adjustable manner relative to the stationary rollers 6 and 6'. A clamping or counter-pressure device 8, in the form of a clamping cylinder, is provided on the walls or supports 2. The upper corrugated rollers 5 and 5' can be supported in a pivotable manner on the bearing brackets 3 and 3', respectively, with a clamping or counter-pressure device assigned to each bearing bracket. The bearing brackets 3 and 3' are further supported in a plurality of adjustable fixed positions with one or more adjusting and fixing devices (not shown).

A clamping roller 9 is located on the walls or supports 2 and cooperates with the lower corrugated roller 6 or 6'. The clamping roller 9 is supported on a lateral bearing bracket 10, which pivots around a rigid axis 11. The bearing bracket 10 can be moved by utilizing a counter-pressure device 12, for example, in the form of a counter-pressure cylinder. Thus assembled, the counter-pressure device 8 presses on the upper corrugated roller 5 (rollers 5 and 6 are shown in the work position in FIG. 1), and the counter-pressure device 12 presses the clamping roller 9 against the lower corrugated roller 6 to provide a firm contact between the rollers 5 and 6.

A glue-applying device 13 is supported on the walls or supports 2 in a pivotable manner through a bearing bracket 14. A glue-applying roller 15 cooperates with the lower corrugated roller 6 or 6' to transfer glue onto the comb unit (not shown) of the paper sheet.

In operation, a smooth paper sheet 16 which is to be corrugated, runs from above the corrugated board machine 1 in the direction of arrow 16a to a preheating cylinder 17, a moisturizing device 18 and a reversal roller 19 to the upper corrugated roller 5 or 5'. As seen in FIG. 1, the paper sheet 16 is corrugated through the cooperation of the upper corrugated roller 5 with the lower corrugated roller 6.

A second smooth paper sheet 20 runs in the direction of arrow 20a, around reversal rollers 21 and 22, a preheating cylinder 23 laterally to the machine 1 and a reversal roller 24 to the clamping roller 9. The sheet 20 loops around the roller 9 where it is glued to the corrugated paper sheet as the sheets 16 and 20 emerge from the lower corrugated roller 6. The resulting one-sided corrugated board then runs around a reversal roller 26 to exit upwardly and away from the machine 1 in the direction of arrow 25a.

When it is desired to change the corrugated roller assemblies I and II, the glue-applying device 13 is first moved away from the path of motion of the roller assembly I, by moving bearing bracket 14 in the clockwise direction. In this example, the corrugated roller assembly I moves into the position represented by the dotted line. The corrugated roller assembly II can then be moved from the rest position to the work position, previously occupied by assembly I, by pivoting the bearing bracket 3 in a clockwise direction around the axis 4'. Thus assembled, the counter-pressure device 8 can apply pressure to the upper corrugated roller 5', and the counter-pressure device 12 can apply pressure to the clamping roller 9 which forces the lower corrugated roller 6' in the direction of the upper corrugated roller 5'. In the above example, the paper sheets 16 and 20 are threaded anew.

Figure 2:
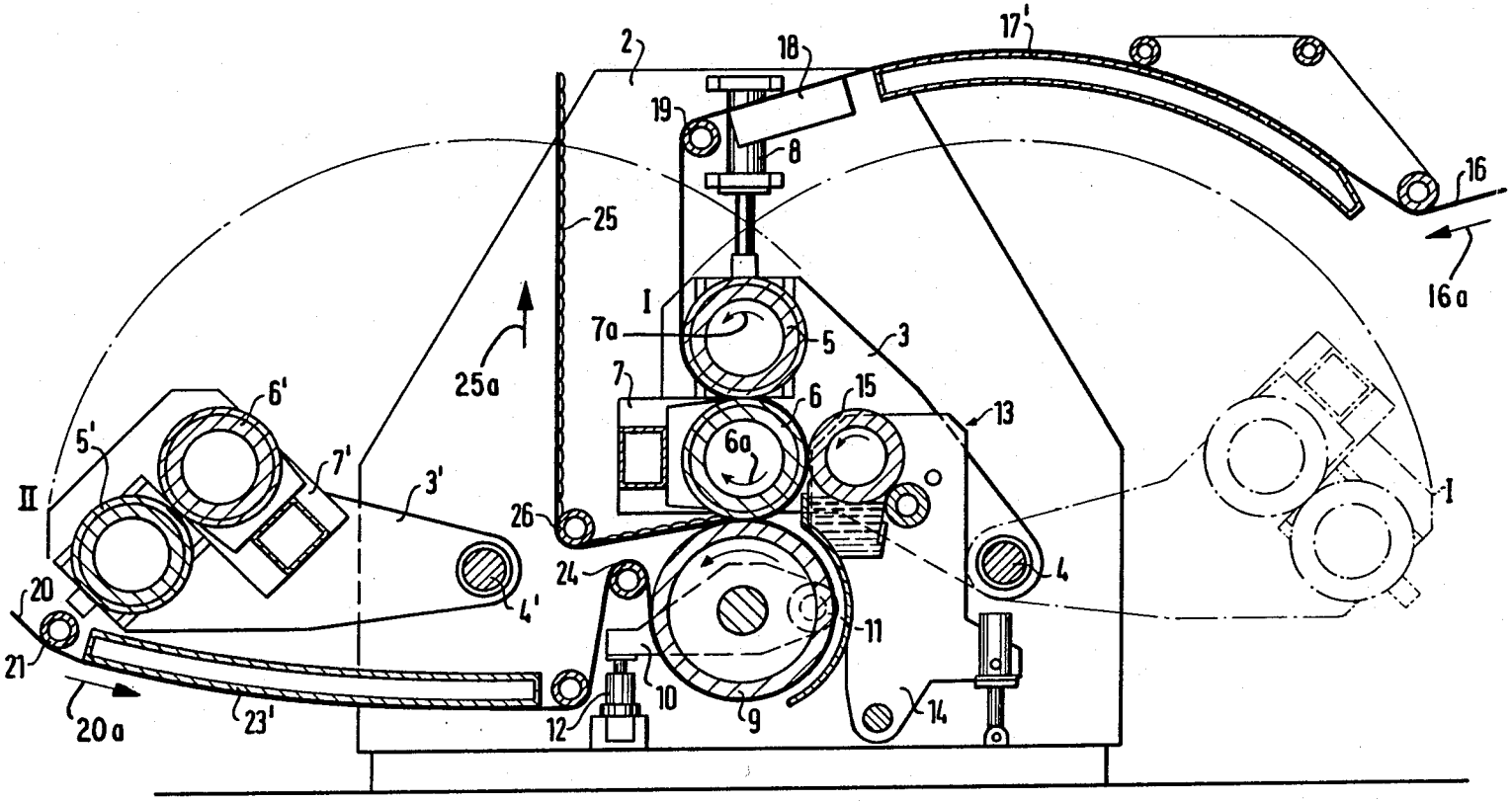
FIG. 2 is a diagrammatic side view of an alternate embodiment of the machine embodying the invention.

A modified embodiment of the present invention is illustrated in FIG. 2. The elements that correspond to FIG. 1 are provided with the same reference numerals. In this embodiment, the roller assembly I includes a provision for the axes of the corrugated rollers and the clamping roller to lie in a vertical plane when the assembly I is in the work position, whereas, in the embodiment in accordance with FIG. 1, the axes lie in a central plane running obliquely. Further, provision is made for curved or elongated preheating devices 17' and 23' instead of the preheating cylinders 17 and 23.

Modification and variations of the present invention are possible in light of the above teachings. A specific dimension is not required so long as the assembled machine is able to function as herein described. It is therefore to be understood that within the scope of the appended claims, the invention may be practiced otherwise than as specifically described.

What is claimed and desired to be secured by Letters Patent of the United States is:

1. A one-sided corrugated board machine with at least two pairs of corrugated rollers which are supported in a drivable manner as assemblies affixed to a support, said machine comprising:

at least two pair of corrugated rollers each pair forming an assembly including a lower corrugated roller and an upper corrugated roller wherein each assembly is supported on a separate pivotally movable bearing bracket pivotably affixed to said support such that said bearing bracket supporting one said assembly originally occupying a work position can be pivotably moved to a first rest position away from said work position and said bearing bracket supporting another said assembly occupying a second rest position separated from said first rest position and said work position can be pivotably moved to said work position;

a glue-applying device affixed on said support such that said device cooperates with said assembly in said work position; and a clamping roller affixed on said support such that said clamping roller cooperates with said assembly in said work position, further providing that said glue-applying device and said clamping roller can be moved away from a path of motion of said assembly when said assembly is moved from one position to another position.

2. The corrugated board machine as defined in claim 1, wherein said bearing brackets are substantially similar and further providing that said path of motion of each of said brackets is substantially opposite one another on opposite sides of a work plane represented by said assembly and said clamping roller when they are in the work position.

3. The corrugated board machine as defined in claim 2, wherein said lower corrugated roller of each assembly is positioned stationary on said bearing bracket and said upper corrugated roller of each assembly is supported on said lower corrugated roller in an adjustable manner such that said clamping roller and said upper corrugated roller can be located relative to said lower corrugated roller to feed material against said lower corrugated roller.

4. The corrugated board machine as defined in claim 3, further including clamping means located on said support for securing said upper corrugated roller in a fixed position relative to said lower corrugated roller.

* * * * *